US006298489B1

(12) United States Patent
Cox

(10) Patent No.: US 6,298,489 B1
(45) Date of Patent: Oct. 9, 2001

(54) CUTTING GLOVE ASSEMBLY

(76) Inventor: Barbara Cox, Porchester Yealmbury Hill, Yealmpton Plymouth Devon, PL8 2JH (GB)

( * ) Notice: Subject to any disclaimer, the term of this patent is extended or adjusted under 35 U.S.C. 154(b) by 0 days.

(21) Appl. No.: 09/759,072

(22) Filed: Jan. 12, 2001

(51) Int. Cl.[7] ..... A41D 19/00

(52) U.S. Cl. ..... 2/161.6; 2/160; 2/163; 30/298; 294/25

(58) Field of Search ..... 2/161.6, 160, 159, 2/161.5, 163; 30/298; 294/25

(56) References Cited

U.S. PATENT DOCUMENTS

| | | | |
|---|---|---|---|
| 79,703 | | 7/1868 | Stewart . |
| 126,474 | | 5/1872 | Meyn . |
| D. 180,984 | | 9/1957 | Zuckerwar . |
| 1,559,839 | | 11/1925 | Asher . |
| 2,294,997 | * | 9/1942 | Merrion . |
| 2,819,521 | | 1/1958 | Parker . |
| 3,593,803 | * | 7/1971 | Ibach . |
| 4,107,840 | * | 8/1978 | Kupperman et al. . |
| 4,149,296 | * | 4/1979 | Stanford . |
| 4,538,320 | * | 9/1985 | Batt . |
| 4,976,032 | * | 12/1990 | Battaglia . |
| 5,708,980 | | 1/1998 | Lamanna et al. . |
| 5,853,210 | * | 12/1998 | Robinson . |

* cited by examiner

*Primary Examiner*—Rodney M. Lindsey

(57) ABSTRACT

A cutting glove assembly for providing a cutting tool which can be conveniently worn upon a user's hand. The cutting glove assembly includes a glove member including a palm portion, a thumb member extending from the palm portion, and an index finger member also extending from the palm portion; and also includes a cutting assembly being securely attached to the glove member.

17 Claims, 1 Drawing Sheet

CUTTING GLOVE ASSEMBLY

BACKGROUND OF THE INVENTION

1. Field of the Invention

The present invention relates to comfortable cutters and more particularly pertains to a new cutting glove assembly for providing a cutting tool which can be conveniently worn upon a user's hand.

2. Description of the Prior Art

The use of comfortable cutters is known in the prior art. More specifically, comfortable cutters heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 79,703; U.S. Pat. No. 5,708,980; U.S. Pat. No. 2,819,521; U.S. Pat. No. 1,559,839; U.S. Pat. No. 126,474; and U.S. Pat. No. Des. 180,984.

While these devices fulfill their respective, particular objectives and requirements, the aforementioned patents do not disclose a new cutting glove assembly. The inventive device includes a glove member including a palm portion, a thumb member extending from the palm portion, and an index finger member also extending from the palm portion; and also includes a cutting assembly being securely attached to the glove member.

In these respects, the cutting glove assembly according to the present invention substantially departs from the conventional concepts and designs of the prior art, and in so doing provides an apparatus primarily developed for the purpose of providing a cutting tool which can be conveniently worn upon a user's hand.

SUMMARY OF THE INVENTION

In view of the foregoing disadvantages inherent in the known types of comfortable cutters now present in the prior art, the present invention provides a new cutting glove assembly construction wherein the same can be utilized for providing a cutting tool which can be conveniently worn upon a user's hand.

The general purpose of the present invention, which will be described subsequently in greater detail, is to provide a new cutting glove assembly which has many of the advantages of the comfortable cutters mentioned heretofore and many novel features that result in a new cutting glove assembly which is not anticipated, rendered obvious, suggested, or even implied by any of the prior art comfortable cutters, either alone or in any combination thereof.

To attain this, the present invention generally comprises a glove member including a palm portion, a thumb member extending from the palm portion, and an index finger member also extending from the palm portion; and also includes a cutting assembly being securely attached to the glove member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cutting glove assembly which has many of the advantages of the comfortable cutters mentioned heretofore and many novel features that result in a new cutting glove assembly which is not anticipated, rendered obvious, suggested, or even implied by any of the prior art comfortable cutters, either alone or in any combination thereof.

It is another object of the present invention to provide a new cutting glove assembly which may be easily and efficiently manufactured and marketed.

It is a further object of the present invention to provide a new cutting glove assembly which is of a durable and reliable construction.

An even further object of the present invention is to provide a new cutting glove assembly which is susceptible of a low cost of manufacture with regard to both materials and labor, and which accordingly is then susceptible of low prices of sale to the consuming public, thereby making such cutting glove assembly economically available to the buying public.

Still yet another object of the present invention is to provide a new cutting glove assembly which provides in the apparatuses and methods of the prior art some of the advantages thereof, while simultaneously overcoming some of the disadvantages normally associated therewith.

Still another object of the present invention is to provide a new cutting glove assembly for providing a cutting tool which can be conveniently worn upon a user's hand.

Yet another object of the present invention is to provide a new cutting glove assembly which includes a glove member including a palm portion, a thumb member extending from the palm portion, and an index finger member also extending from the palm portion; and also includes a cutting assembly being securely attached to the glove member.

Still yet another object of the present invention is to provide a new cutting glove assembly that allows people with arthritis to use a cutting tool to cut various items and objects.

Even still another object of the present invention is to provide a new cutting glove assembly that conveniently incorporates a glove with a scissors-like tool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
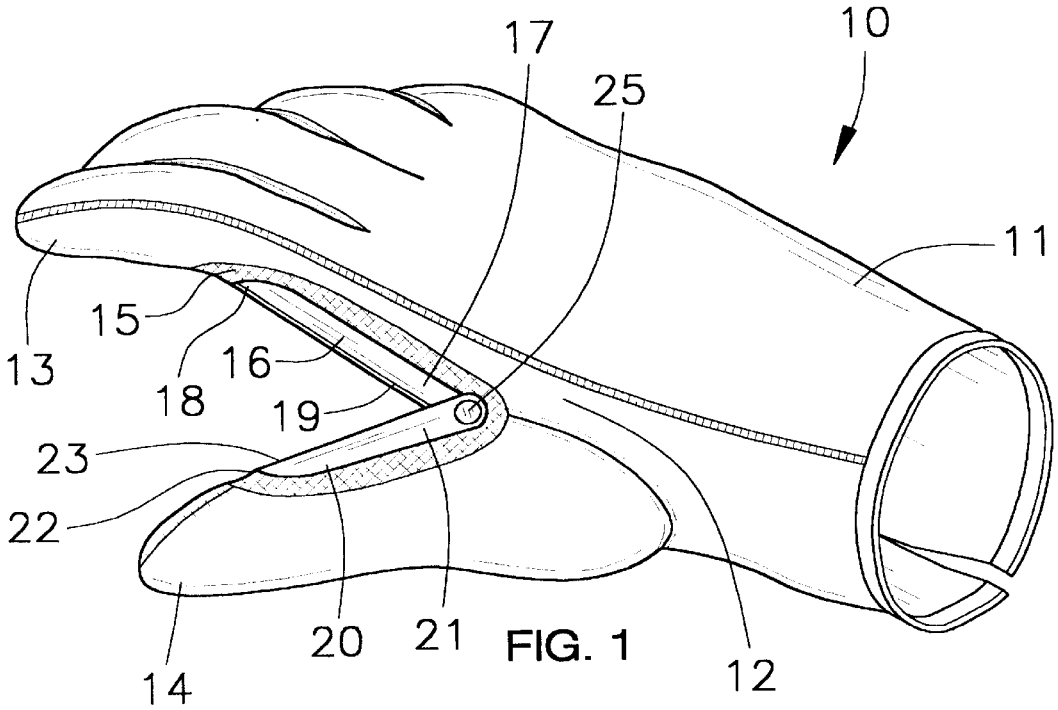
FIG. 1 is a perspective view of a new cutting glove assembly according to the present invention.
Figure 2:
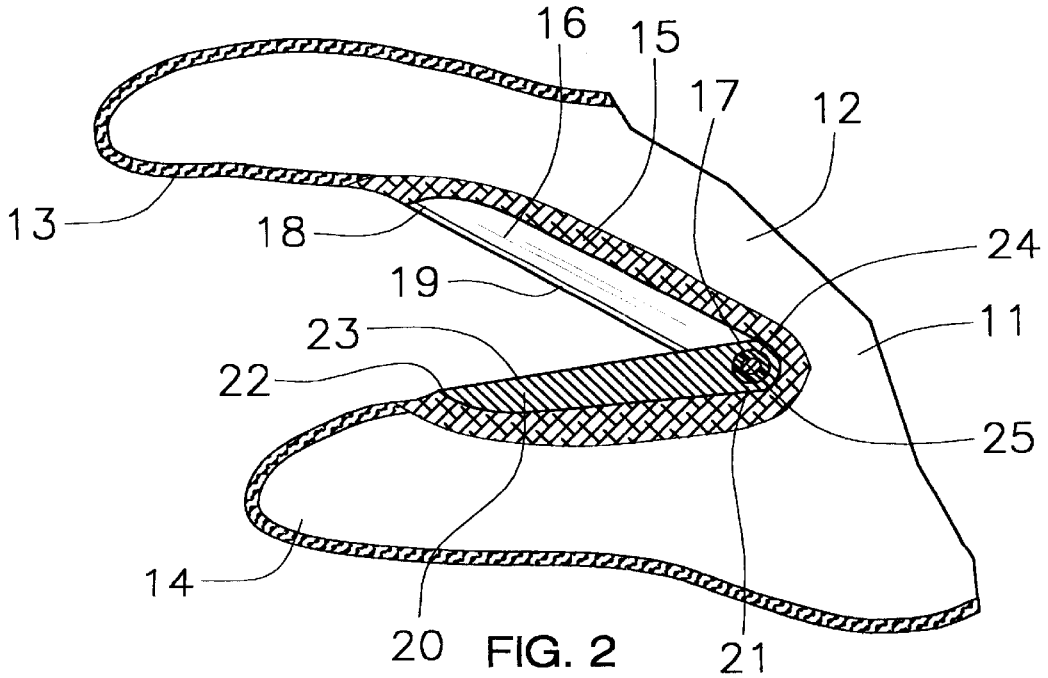
FIG. 2 is a side elevational view of the present invention.

With reference now to the drawings, and in particular to FIGS. 1 through 2 thereof, a new cutting glove assembly embodying the principles and concepts of the present invention and generally designated by the reference numeral 10 will be described.

As best illustrated in FIGS. 1 through 2, the cutting glove assembly 10 generally comprises a glove member 11 including a palm portion 12, a thumb member 14 conventionally extending from the palm portion 12, and an index finger member also conventionally extending from the palm portion 12. The glove member 11 further includes a rigid material 15 being conventionally disposed along portion of the palm portion 12, the index finger member 13 and the thumb member 14. The rigid material 15 is comprised of rubber and other composite materials.

A cutting assembly is securely and conventionally attached to the glove member 11 and includes a pair of blade members 16,20 having first ends 17,21 which are hingedly attached to one another. The pair of blade members 16,20 include a first blade member 16 which is securely and conventionally attached upon a portion of the rigid material 15 and along portions of the palm portion 12 and the index finger member 13, and also includes a second blade member 20 which is securely and conventionally attached upon another portion of the rigid material 15 and along a portion of the thumb member 14. The cutting assembly further includes a pivot 24,25 being disposed in holes which are disposed through the first and second blade members 16,20 near the first ends 17,21 thereof. The pivot 24,25 includes a bushing 24 which is securely and conventionally disposed in the holes and also includes a pin-like fastening member 25 which is removably and securely disposed in the bushing 24. The first ends 17,21 of the first and second blade members 16,20 are securely and conventionally attached to an edge of the palm portion 12 between the thumb member 14 and the index finger member 13 and near a base of the thumb member 14. The first and second blade members 16,20 have pointed second ends 18,22 and also have longitudinal cutting edges 19,23 extending along lengths thereof.

In use, the user slips the glove member 11 upon the appropriate hand and operates the first and second blade members 16,20 by moving one's index finger and thumb member toward and away from one another which causes the first and second blade members 16,20 to move toward and away from one another thus causing a scissors action. The user can place items and objects between the first and second blade member 16,20 and can cut such objects and items with the longitudinal cutting edges 19,23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cutting glove assembly comprising:

a glove member including a palm portion, a thumb member extending from said palm portion, and an index finger member also extending from said palm portion;

a cutting assembly being securely attached to said glove member; and wherein said glove member further includes a rigid material being disposed along portions of said palm portion, said index finger member and said thumb member.

2. A cutting glove assembly as described in claim 1, wherein said rigid material is comprised of rubber and other composite materials.

3. A cutting glove assembly as described in claim 1, wherein said cutting assembly includes a pair of blade members having first ends which are hingedly attached to one another.

4. A cutting glove assembly as described in claim 3, wherein said pair of blade members includes a first blade member which is securely attached upon a portion of said rigid material and along portions of said palm portion and said index finger member, and also includes a second blade member which is securely attached upon another portion of said rigid material and along a portion of said thumb member.

5. A cutting glove assembly as described in claim 4, wherein said cutting assembly further includes a pivot being disposed in holes which are disposed through said first and second blade members near said first ends thereof.

6. A cutting glove assembly as described in claim 5, wherein said pivot includes a bushing which is securely disposed in said holes and also includes a pin-like fastening member which is removably and securely disposed in said bushing.

7. A cutting glove assembly as described in claim 4, wherein said first ends of said first and second blade members are securely attached to an edge of said palm portion between said thumb member and said index finger member and near a base of said thumb member.

8. A cutting glove assembly as described in claim 4, wherein said first and second blade members have pointed second ends and also have longitudinal cutting edges extending along lengths thereof.

9. A cutting glove assembly comprising:

a glove member including a palm portion, a thumb member extending from said palm portion, and an index finger member also extending from said palm portion, said glove member further including a rigid material being disposed along portions of said palm portion, said index finger member and said thumb member, said rigid material being comprised of rubber and other composite materials; and a cutting assembly being securely attached to said glove member and including a pair of blade members having first ends which are hingedly attached to one another, said pair of blade members including a first blade member which is securely attached upon a portion of said rigid material and along portions of said palm portion and said index finger member, and also including a second blade member which is securely attached upon another portion of said rigid material and along a portion of said thumb member, said cutting assembly further including a pivot being disposed in holes which are disposed through said first and second blade members near said first ends thereof, said pivot including a bushing which is securely disposed in said holes and also including a pin-like fastening member which is removably and securely disposed in said bushing, said first ends of said first and second blade members being securely attached to an edge of said palm portion between said thumb member and said index finger member and near a base of said thumb member, said first and second blade members having pointed second ends and also having longitudinal cutting edges extending along lengths thereof.

10. A cutting glove assembly comprising:

a glove member including a palm portion, a thumb member extending from said palm portion, and an index finger member also extending from said palm portion;

a cutting assembly being securely attached to said glove member, said cutting assembly including a pair of blade members having first ends which are hingedly attached to one another, a first one of said blade members being mounted on and extending along said thumb member of said glove member and a second one of said blade members being mounted on said palm portion and extending toward said index finger member.

11. A cutting glove assembly as described in claim 10, wherein said first and second blade members have pointed second ends and also have longitudinal cutting edges extending along lengths thereof.

12. A cutting glove assembly as described in claim 10, wherein said second blade member extends along a portion of said index finger member of said glove member.

13. A cutting glove assembly as described in claim 10, wherein said glove member further includes a rigid material being disposed along portions of said palm portion, said index finger member and said thumb member.

14. A cutting glove assembly as described in claim 13, wherein said first blade member is attached upon a portion of said rigid material on said palm portion, and said second blade member is attached upon another portion of said rigid material on said thumb member.

15. A cutting glove assembly as described in claim 10, wherein said cutting assembly further includes a pivot being disposed in holes which are disposed through said first and second blade members near said first ends thereof.

16. A cutting glove assembly as described in claim 15, wherein said pivot includes a bushing which is securely disposed in said holes and also includes a pin-like fastening member which is removably and securely disposed in said bushing.

17. A cutting glove assembly as described in claim 13, wherein said rigid material is comprised of an elastomeric material.

* * * * *